US008893632B1

(12) United States Patent
Tseng

(10) Patent No.: US 8,893,632 B1
(45) Date of Patent: Nov. 25, 2014

(54) THREAD HOOKING DEVICE FOR A HEMMING DEVICE OF A SEWING MACHINE

(71) Applicant: Hsien-Chang Tseng, Taichung (TW)

(72) Inventor: Hsien-Chang Tseng, Taichung (TW)

( * ) Notice: Subject to any disclaimer, the term of this patent is extended or adjusted under 35 U.S.C. 154(b) by 0 days.

(21) Appl. No.: 13/920,479

(22) Filed: Jun. 18, 2013

(51) Int. Cl.
*D05B 57/02* (2006.01)
*D05B 87/02* (2006.01)
*D05B 57/00* (2006.01)

(52) U.S. Cl.
CPC ..... *D05B 87/02* (2013.01)
USPC ..... 112/199

(58) Field of Classification Search
USPC ..... 112/162, 199, 200, 302
See application file for complete search history.

(56) References Cited

U.S. PATENT DOCUMENTS 4,942,835 A * 7/1990 Oguri ..... 112/302
4,977,842 A * 12/1990 Fukao et al. ..... 112/199
5,347,941 A * 9/1994 Mizuno ..... 112/199
6,450,109 B1 * 9/2002 Lu ..... 112/199

FOREIGN PATENT DOCUMENTS

JP 402200298 A * 8/1990

* cited by examiner

*Primary Examiner* — Ismael Izaguirre

(57) ABSTRACT

A thread hooking device for a hemming device of a sewing machine is provided with a swing arm driven to move by a drive shaft. The first hook is formed with a guide portion on which being slidably mounted a thread hooking member 40 located at a second end of the guide portion. The thread hooking member is formed a thread hooking portion, the thread is inserted into the thread groove via the thread hooking portion and then extends out of the thread hole. The thread guiding member moves from the second end of the guide portion to the first end of the guide portion, when the thread hooking is aligned to the first end of the guide portion, the thread is inserted through the thread hole, moving the thread hooking member to the second end of the guide portion makes the thread insert in the thread groove.

9 Claims, 7 Drawing Sheets

THREAD HOOKING DEVICE FOR A HEMMING DEVICE OF A SEWING MACHINE

BACKGROUND OF THE INVENTION

1. Field of the Invention

The present invention relates to an automatic thread hooking device, and more particularly to a thread hooking device for a hemming device of a sewing machine.

2. Description of the Prior Art

A sewing machine is usually provided with an upper thread hook in order to perform hemming. In order for the thread on the upper thread hook to be quickly inserted and guided, many automatic thread hooking devices have been invented. For instance, there is an automatic thread hooking device which is provided with a pivotable thread hooking member, wherein the thread cannot be fully enclosed after being hooked and is very likely to disengage from the thread hooking member or even break during the hemming operation.

The present invention has arisen to mitigate and/or obviate the afore-described disadvantages.

SUMMARY OF THE INVENTION

The primary objective of the present invention is to provide a thread hooking device for a hemming device of a sewing machine, wherein thread hooking and inserting operation can be performed automatically when the thread hooking member slides along a guide portion.

To achieve the above objective, a thread hooking device for a hemming device of a sewing machine in accordance with the present invention comprises: a swing arm with one end connected to and moved by a drive shaft, and at another end of the swing arm being provided a first hook which is provided at one end thereof with a thread hole for the passage of a thread, an elongated thread groove being formed on a surface of the hook portion and having one end connected to the thread hole.

The thread hooking device is characterized in that: in the middle of the first hook is formed a guide portion with a first end and a second end, a thread hooking member is slidably mounted on the guide portion and located at the second end of the guide portion, at one end of the thread hooking member is formed a thread hooking portion, the thread is inserted into the thread groove via the thread hooking portion and then extends out of the thread hole. The thread guiding member moves from the second end of the guide portion to the first end of the guide portion, when the thread hooking is aligned to the first end of the guide portion, the thread is inserted through the thread hole, moving the thread hooking member to the second end of the guide portion makes the thread insert in the thread groove.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
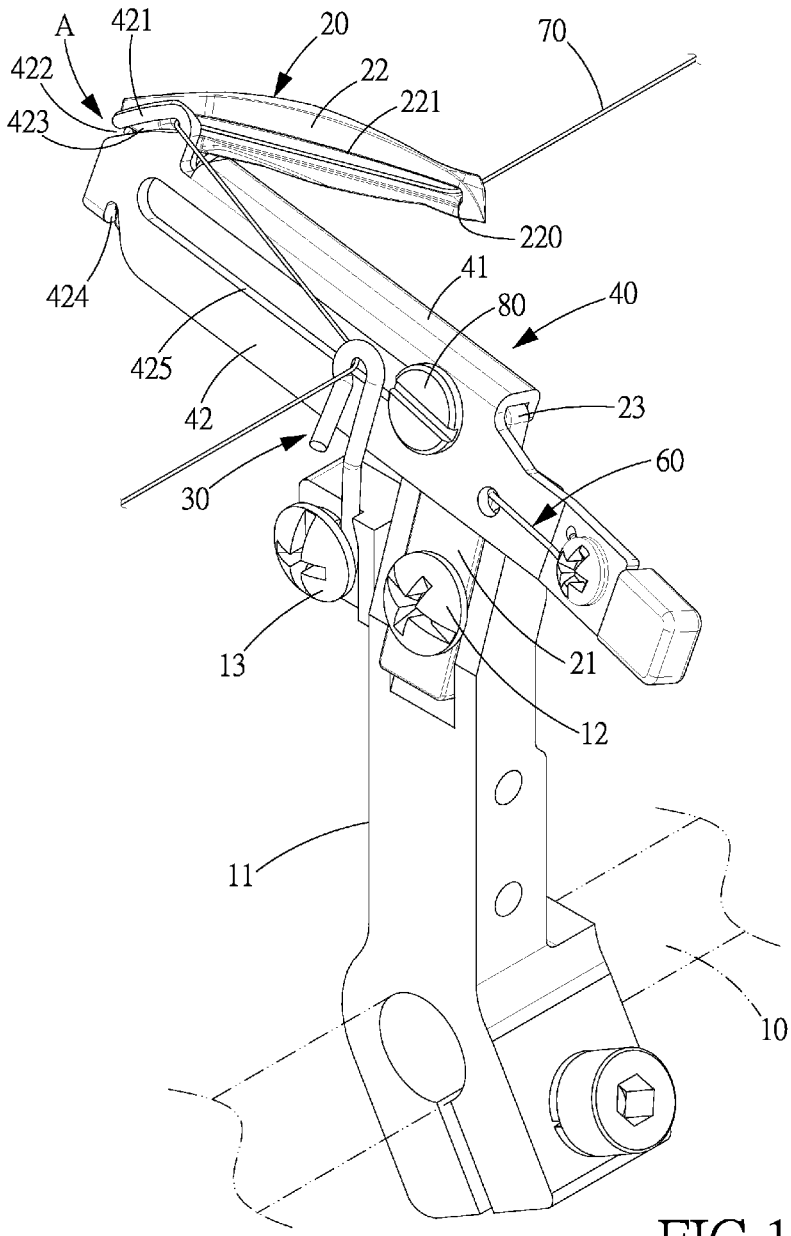
FIG. 1 is a perspective view of a thread hooking device for a hemming device of a sewing machine in accordance with a preferred embodiment of the present invention.
Figure 2:
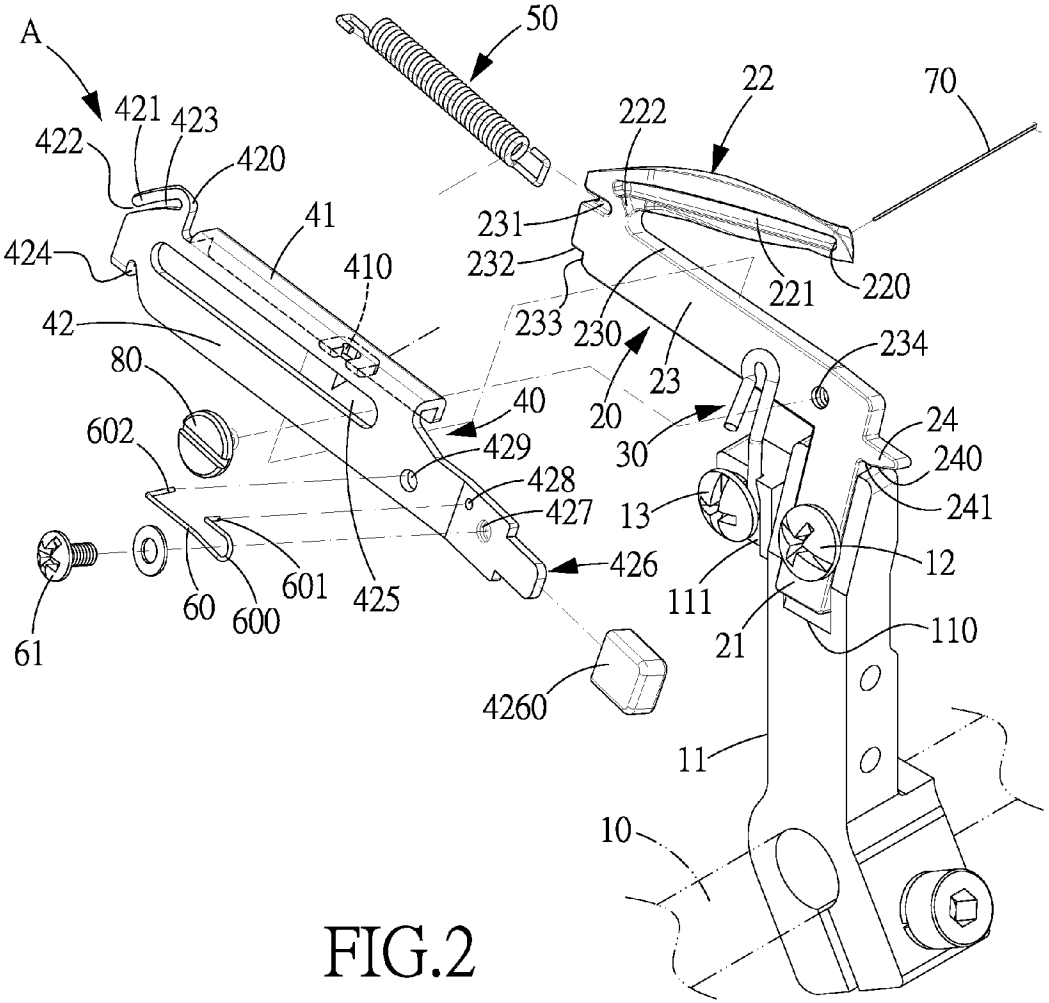
FIG. 2 is an exploded view of the thread hooking device for a hemming device of a sewing machine in accordance with the preferred embodiment of the present invention.
Figure 3:
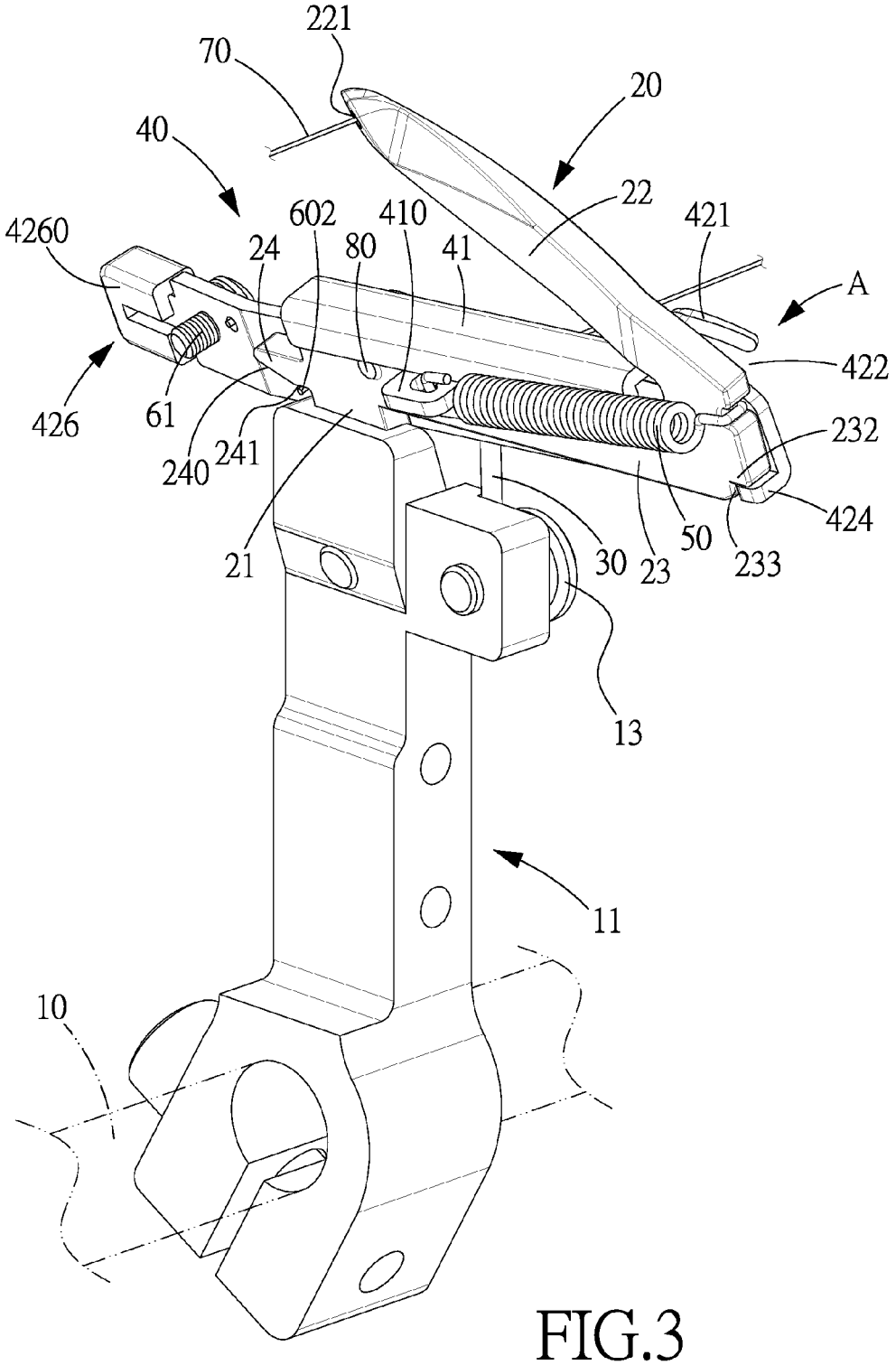
FIG. 3 is another angle view of FIG. 1.

Referring to FIGS. 1-3, a thread hooking device for a hemming device of a sewing machine in accordance with a preferred embodiment of the present invention is shown, wherein the hemming device includes a swing arm 11 with one end connected to and moved by a drive shaft 10, and at another end of the swing arm 11 are provided a first hook 20 and a second hook 30. The present invention is characterized in that at the middle of the first hook 20 is provided with a thread hooking member 40, and a return member 50 which is hooked between the first hook 20 and the thread hooking member 40 to make the thread hooking member 40 return to its original position automatically. On the thread hooking member 40 is provided a stop member 60 which cooperates with the first hook 20 to prevent the thread hooking member 40 from moving back once the thread hooking member 40 returns to its original position. Sliding the thread hooking member 40 can quickly position the thread 70 inserted between the first hook 20 and the second hook 30, and with the thread hooking member 40 and the stop member 60, the present invention is capable of achieving the purpose of quick inserting, hooking and positioning the thread.

The swing arm 11 has one end fixed to and driven to swing by the drive shaft 10, another end of the swing arm 11 are formed a first groove 110 and a second groove 111 to fix the first and second hooks 20, 30, respectively, by cooperating with a first bolt 12 and a second bolt 13. The second hook 30 is an elastic rod folded into a hook with an open end toward the swing arm 11.

The first hook 20 is a sheet structure formed into an S shape with an acute angle. One end of the first hook 20 is a straight connecting portion 21 which is inserted in the first groove 110 of the swing arm 11 and fixed therein by the first bolt 12. Another end of the first hook 20 extends out of the first groove 110 and is formed with a hook portion 22, and a thread hole 220 is formed at one end of the hook portion 22 for the passage of thread. An elongated thread groove 221 is formed on the surface of the hook portion 22 and has one end connected to the thread hole 220, and another end of the thread groove 221 is folded into an abutting portion 222, so that the thread hooking member 40 can be positioned by abutting against the abutting portion 222 when it returns to its original position.

The characteristic of the present invention lies in the arrangement of the thread hooking member 40 and the structure of the first hook 20 for cooperating with the thread hooking member 40. In the middle of the first hook 20, namely between the hook portion 22 and the connecting portion 21 is formed a flat and straight guide portion 23 which has a first end connected to the connecting portion 21 and a second end connected to abutting portion 222 of the hook portion 22. The top of the guide portion 23 is a saddle portion 230 for the thread hooking member 40 to slidably ride thereon. The second end of the guide portion 23 is formed a concaved positioning portion 231 adjacent to the hook portion 22, and at a lower portion of the first end of the guide portion 23 are formed a restrict portion 232 and a stop portion 233 which are connected to each other in such a manner that the restrict portion 232 is parallel to the bottom of the guide portion 23, and the stop portion 233 is perpendicular to the restrict portion 232. At the first end of the guide portion 23 is formed a protrusion 24 with an inclined bottom 240, and at the inclined bottom 240 is formed a horizontal rib 241 against which the stop member 60 is abutted. Close to the guide portion 23 is further formed a first threaded hole 234, so that a third bolt 80 is inserted through the thread hooking member 40 and screwed into the first threaded hole 234 to fix the thread hooking member 40 to the guide portion 23.

The thread hooking member 40 is formed by folding of an elongated sheet member, its top is a riding portion 41 with a U-shaped cross section to ride on the saddle portion 230. The thread hooking member 40 includes a lateral wall 42 extending from the riding portion 41 and a thread hooking portion A protruding upward from the end of the lateral wall 42. The thread hooking portion A has various embodiments to meet different demands. In this embodiment as shown, the thread hooking portion A includes a base portion 420, a thread hook 421 protruding upward in an inclined manner, and a slot 423 which is defined between the base portion 420 and the thread hook 421 and has an opening 422 open toward the second end of the guide portion 23. The lateral wall 42 is further provided below the base portion 420 with an extension portion 424 perpendicular to the lateral wall 42 and located corresponding to the lower portion of the first end of the guide portion 23, and an elongated slot 425 below and in parallel to the riding portion 41 for insertion of the third bolt 80. On the lateral wall 42 is also formed a push portion 426 covered with a rubber cover 4260 and located corresponding to the guide portion 23, so that a user can push the thread hooking member 40 to move by pushing the push portion 426. Beside the push portion 426 are a formed a second threaded hole 427, a positioning hole 428 adjacent to the second threaded hole 427, and a through hole 429 which is located such that it will be aligned right to the bottom of the protrusion 24 when the thread hooking member 40 reaches the end of its travel toward the guide portion 23 of the first hook 20. In the middle of the riding portion 41 is formed a horizontally protruding ear 410. The return member 50 is a helical spring with one end hooked to the protruding ear 410 and another end hooked to the concave positioning portion 231, so as to provide an elastic force for pushing the thread hooking member 40 back to its original position (namely the start point) of its travel by pushing the base portion 420 of the thread hooking member 40 toward the abutting portion 222.

One end of the stop member 60 is a semicircular end 600 whose tip end is folded by 90 degrees into a positioning end 601, another end of the stop member 60 is also folded by 90 degrees into a push end 602, and between the positioning end 601 and the push end 602 is a horizontally extending elongated elastic body of the stop member 60. A fourth bolt 61 is inserted through the semicircular end 600 and screwed into the second threaded hole 427, and the positioning end 601 is inserted into the positioning hole 428, so that the stop member 60 is fixed to the thread hooking member 40 and provides an elastic force to the push end 602. The push end 602 is movably received in the through hole 429 since the through hole 429 has an inner diameter larger than the outer diameter of the push end 602.

When the thread hooking member 40 is at the start point of its travel, the thread hook 421 of the thread hooking member 40 will be located at the second send of the guide portion 23 in such a manner that the base portion 420 is abutted against the abutting portion 222, the thread 70 is inserted from the bottom of the slot 423 into the thread groove 221 and extends out of the thread hole 220, the extension portion 424 of the thread hooking member 40 is stopped against the stop portion 233 of the first hook 20, and the push end 602 of the stop member 60 is elastically pressed against the bottom of the horizontal rib 241 of the protrusion 24 to provide an elastic force to make the thread hooking member 40 pivot about the third bolt 80 until the extension portion 424 is abutted against the restrict portion 232 and stop by the stop portion 233. By such arrangements, the thread hooking member 40 is fixed at the start point of its travel without moving backward. In the case that the thread 70 is broken, it can be reinserted into the thread hole 220 and the second hook 30 again by the following steps: pushing the thread hooking member 40 to move along an unlocking travel path a, as shown in FIG. 4, then pushing the thread hooking device 40 to move along a forward travel path b until the thread hook 421 is pushed against the first end of the guide portion 23, then releasing (stop pushing) the thread hooking member 40, at this moment, the thread hooking member 40 will be pushed by the return member 50 to move back to its original position by moving along a backward travel path c while the thread hook 421 hooks the thread 70.

Figure 4:
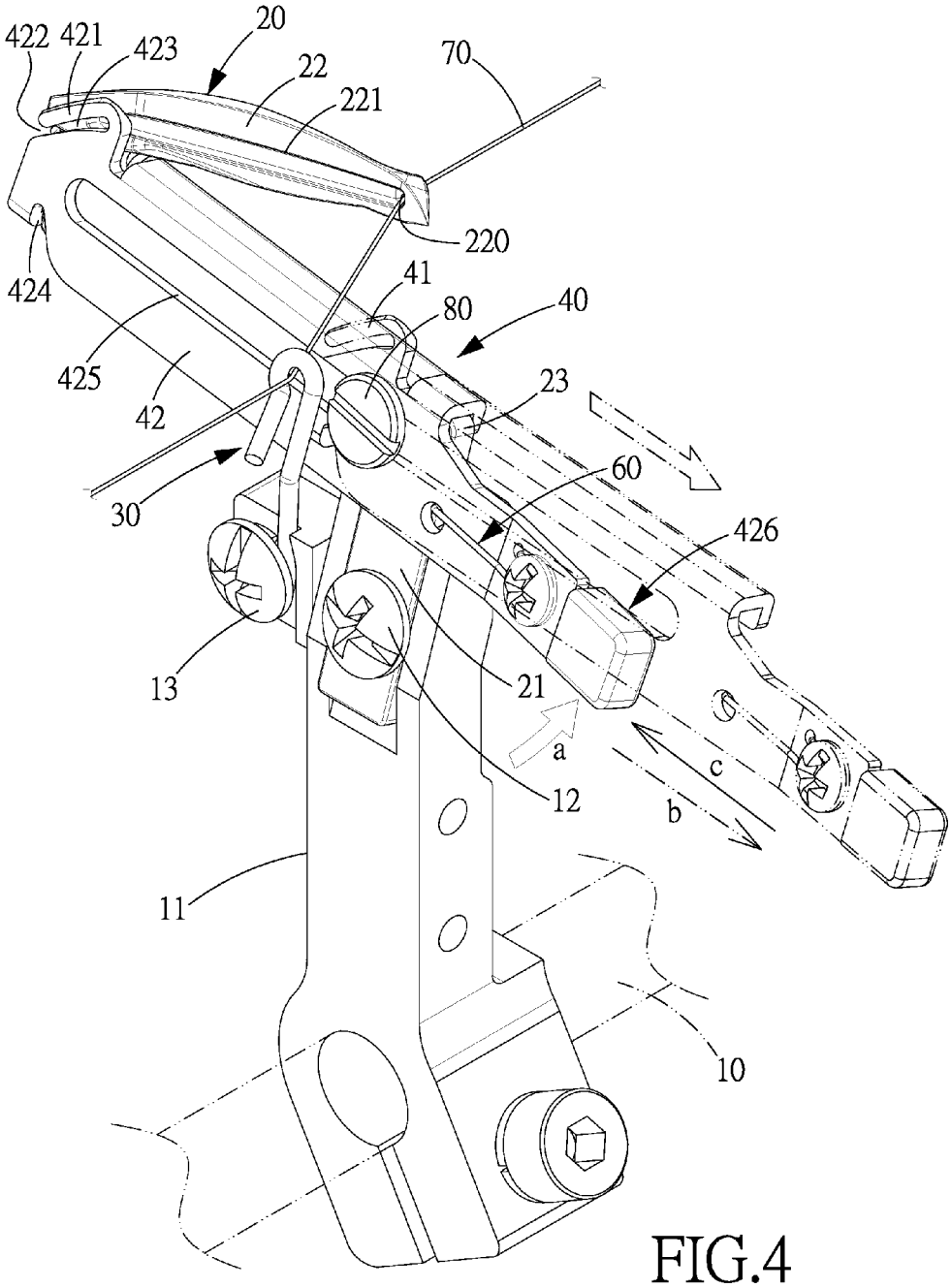
FIG. 4 is an operational view of the present invention showing that the thread hooking member slides along the first hook to hook the thread.
Figure 5:
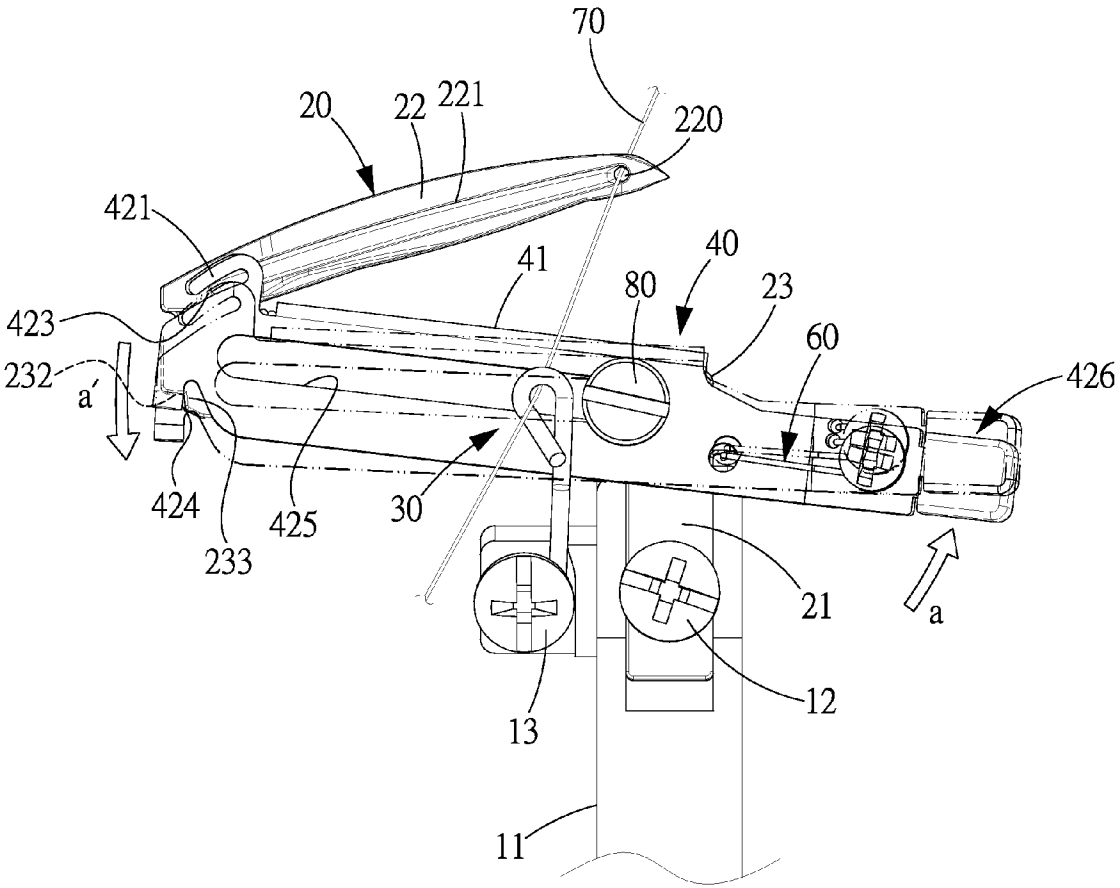
FIG. 5 is an operational view of the present invention showing the unlocking of the thread hooking member from the first hook.
Figure 6:
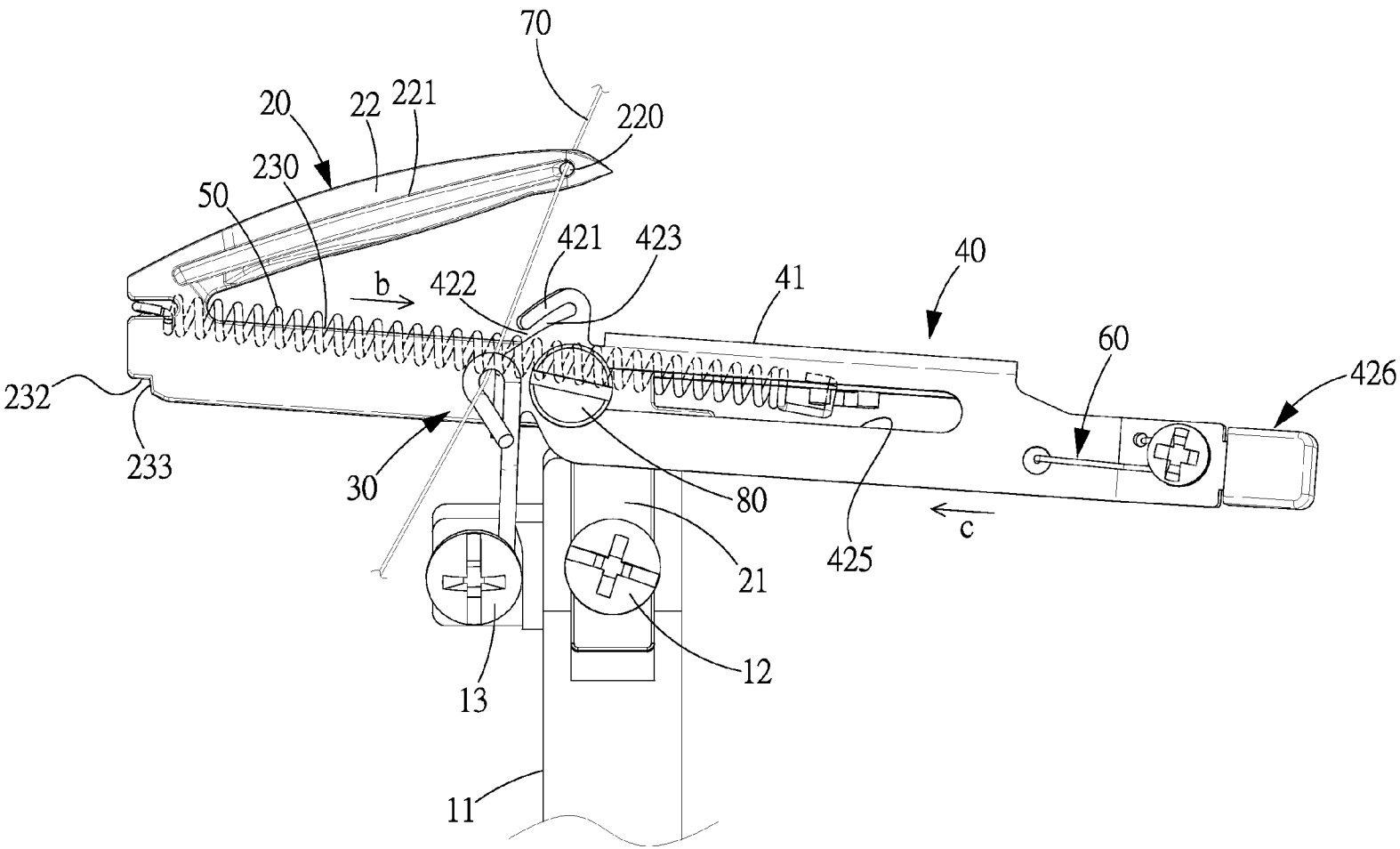
FIG. 6 is an operational view of the present invention showing that the thread hooking member is pulled forward to another side of the first hook.

Referring to FIGS. 4 and 5, the unlocking travel path a means that the push portion 426 is pushed upward to make the thread hooking member 40 pivot about the third bolt 80, and make the extension portion 424 of the thread hooking member 40 pivot along a direction a' until the extension portion 424 is disengaged from the restrict portion 232 and the stop portion 233, as shown in FIG. 6. Then, the push portion 426 is pulled forward to make the thread hooking member 40 move along the surface of the first hook 20 while stretching return member 50, under the guidance of the third bolt 80 moving along the elongated slot 425 and the riding portion 41 riding on the saddle portion 230, until the thread hooking member 40 moves to the first end of the guide portion 23 and reaches the end of the forward travel path b, which is also the start point of the travel path for inserting and hooking the thread, where the opening 422 of the slot 423 is right aligned to the thread 70. At this moment, the thread hooking member 40 can be released and consequently will be pulled to slide along the backward travel path c by the return member 50, so that the thread 70 can be hooked by the thread hook 421 by sliding into the slot 423 via the opening 422 and then into the thread groove 221. Then, the thread hooking member 40 moves until the base portion 420 is pushed against the abutting portion 222, so that the thread 70 is done with thread inserting and hooking operation in a quick and automatic manner, namely, the thread 70 is inserted in the thread groove 221 via the slot 423 and extends out of the thread hole 220.

Meanwhile, the push end 602 of the stop member 60 moves along the inclined bottom 240 of the protrusion 24 to the horizontal rib 241, providing a force making the thread hooking member 40 pivot about the third bolt 80, making the extension portion 424 move into the perimeter of the stop portion 233 and stopped against the restrict portion 232, so that the stop portion 233 stops the extension portion 424 from retracting, making the thread hooking member 40 firmly fixed to the first hook 20, and thus the locking operation is finished after the thread inserting and hooking operation. When the first hook 20 swings, the thread hooking member 40 will be affected by the centrifugal force to make the extension portion 424 stably engaged in between the restrict portion 232 and the stop portion 233.

Figure 7:
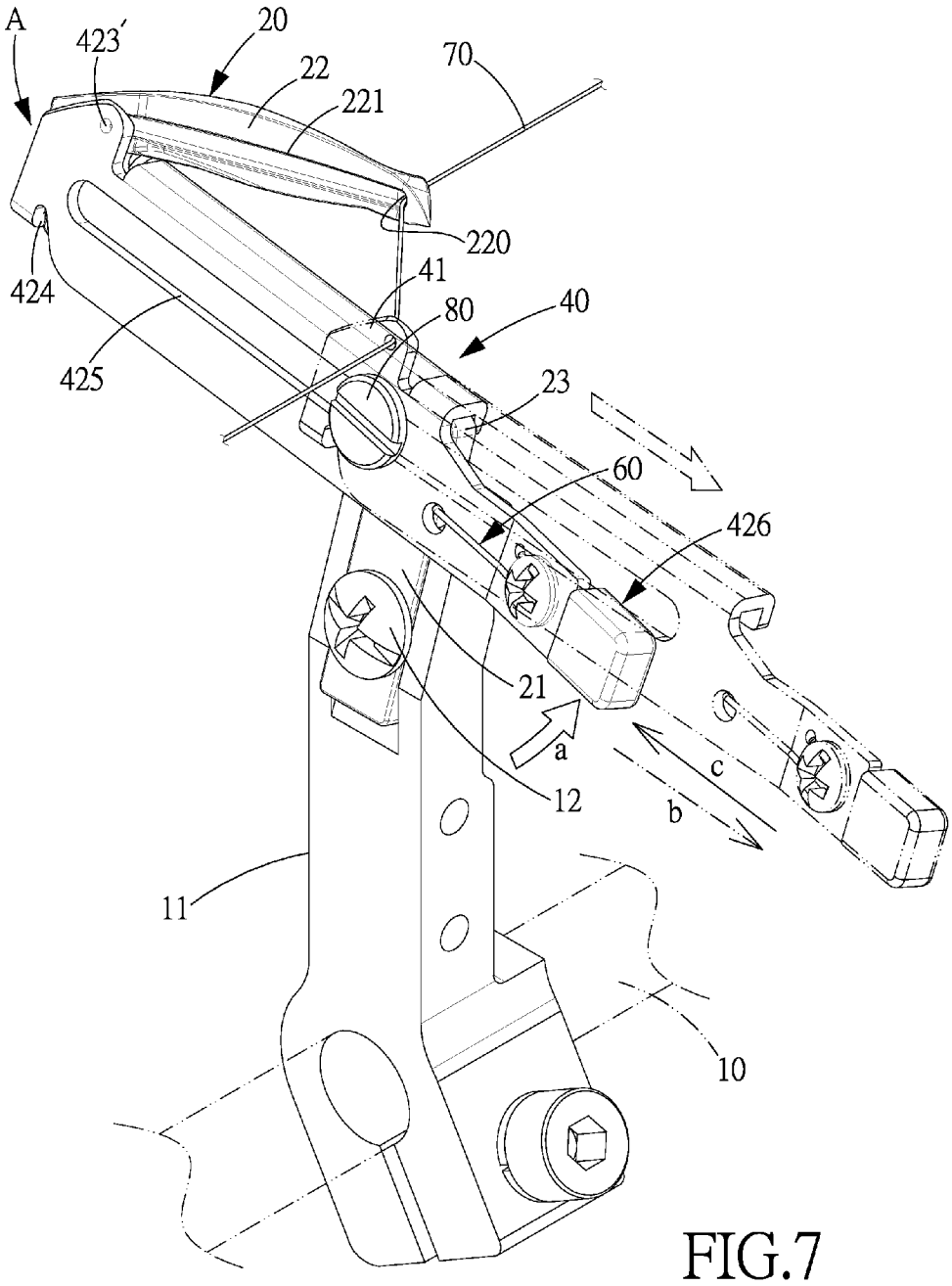
FIG. 7 is a perspective view of a thread hooking device for a hemming device of a sewing machine in accordance with another preferred embodiment of the present invention.

The thread hooking portion A can also be formed with an inserting hole 423' which will right be aligned to the thread hole 220, when the thread hooking member 40 moves to the first end of the guide portion 23, as shown in FIG. 7, so that the thread 70 can be directly inserted through the thread hole 220 and the inserting hole 423', then the thread hooking member 40 moves back to the second end of the guide portion 23 to make the thread 70 received in the thread groove 221.

While we have shown and described various embodiments in accordance with the present invention, it is clear to those skilled in the art that further embodiments may be made without departing from the scope of the present invention.

What is claimed is:

1. A thread hooking device for a hemming device of a sewing machine, comprising a swing arm with one end connected to and moved by a drive shaft, and at another end of the swing arm being provided a first hook which is provided at one end thereof with a thread hole for the passage of a thread, an elongated thread groove being formed on a surface of the hook portion and having one end connected to the thread hole, the thread hooking device being characterized in that:

in the middle of the first hook is formed a guide portion with a first end and a second end, a thread hooking member is slidably mounted on the guide portion and located at the second end of the guide portion, at one end of the thread hooking member is formed a thread hooking portion, the thread is inserted into the thread groove via the thread hooking portion and then extends out of the thread hole;

a thread guiding member moves from the second end of the guide portion to the first end of the guide portion, when the thread hooking is aligned to the first end of the guide portion, the thread is inserted through the thread hole, moving the thread hooking member to the second end of the guide portion makes the thread insert in the thread groove;

the top of the guide portion is a saddle portion, and a top of the thread hooking member is a riding portion to ride on the saddle portion.

2. The thread hooking device for a hemming device of the sewing machine as claimed in claim 1, wherein the thread hooking portion includes a thread hook, and a slot with an opening open toward the second end of the guide portion;

after the thread is inserted through the thread hole, and when the thread hooking member moves from the first end to the second end of the guide portion, the opening of the thread hooking member will pull the thread into the thread groove.

3. The thread hooking device for a hemming device of the sewing machine as claimed in claim 1, wherein the thread hooking portion is formed with an inserting hole.

4. The thread hooking device for a hemming device of the sewing machine as claimed in claim 1, wherein another end of the first hook is formed with a hook portion, the thread groove is formed on the hook portion and has one end connected to the thread hole, and another end of the thread groove is folded into an abutting portion, and the thread hooking member includes a base portion and a thread hook.

5. The thread hooking device for a hemming device of the sewing machine as claimed in claim 1, wherein the guide portion is provided with a first threaded hole, the thread hooking member is formed by folding of an elongated sheet member, the riding portion has a U-shaped cross section, the thread hook device includes a lateral wall extending from the riding portion, and the lateral wall is provided with an elongated slot below and in parallel to the riding portion for insertion of a third bolt.

6. The thread hooking device for a hemming device of the sewing machine as claimed in claim 1, wherein a restrict portion and a stop portion are formed at a lower portion of the first end of the guide portion, at the first end of the guide portion is formed a protrusion with an inclined bottom, and at the inclined bottom is formed a horizontal rib, the lateral wall is provided with an extension portion perpendicular to the lateral and located corresponding to the lower portion of the first end of the guide portion, and a push portion covered with a rubber cover and located corresponding to the guide portion, beside the push portion are a formed a second threaded hole, a positioning hole adjacent to the second threaded hole, and a through hole which is located such that it will be aligned right to the bottom of the protrusion when the thread hooking member reaches the end of its travel toward the guide portion of the first hook, a stop member has a semicircular end whose tip end is folded by degrees into a positioning end, another end of the stop member is also folded by degrees into a push end, and between the positioning end and the push end is a horizontally extending elongated elastic body of the stop member, a fourth bolt is inserted through the semicircular end and screwed into the second threaded hole, and the positioning end is inserted into the positioning hole, the push end is movably received in the through hole since the through hole has an inner diameter larger than the outer diameter of the push end.

7. The thread hooking device for a hemming device of the sewing machine as claimed in claim 1, wherein a return member is disposed between the first hook and the thread hooking member.

8. A thread hooking device for a hemming device of a sewing machine, comprising a swing arm with one end connected to and moved by a drive shaft, and at another end of the swing arm being provided a first hook which is provided at one end thereof with a thread hole for the passage of a thread, an elongated thread groove being formed on a surface of the hook portion and having one end connected to the thread hole, the thread hooking device being characterized in that:

in the middle of the first hook is formed a guide portion with a first end and a second end, a thread hooking member is slidably mounted on the guide portion and located at the second end of the guide portion, at one end of the thread hooking member is formed a thread hooking portion, the thread is inserted into the thread groove via the thread hooking portion and then extends out of the thread hole;

the thread guiding member moves from the second end of the guide portion to the first end of the guide portion, when the thread hooking is aligned to the first end of the guide portion, the thread is inserted through the thread hole, moving the thread hooking member to the second end of the guide portion makes the thread insert in the thread groove a stop portion is formed at a lower portion of the first end of the guide portion, at the first end of the guide portion is formed a protrusion with an inclined bottom, the lateral wall is provided with an extension portion located corresponding to the lower portion of the first end of the guide portion and a push portion located corresponding to the guide portion, beside the push portion is a stop member which has one end fixed to the lateral wall, and another push end, the thread hooking member is located at the second end of the guide portion to provide an elastic force in such a manner that the push end is pushed against the inclined bottom, and the extension portion is stopped from moving back by the stop portion.

9. The thread hooking device for a hemming device of the sewing machine as claimed in claim 8, wherein a restrict portion which is connected to the stop portion is formed at a lower portion of the first end of the guide portion, at the inclined bottom is formed a horizontal rib, the lateral wall is provided with a formed a second threaded hole, a positioning hole adjacent to the second threaded hole, and a through hole which is located such that it will be aligned right to the bottom of the protrusion when the thread hooking member reaches the end of its travel toward the guide portion of the first hook, a stop member has a semicircular end whose tip end is folded by 90 degrees into a positioning end, another end of the stop member is also folded by 90 degrees into a push end, and between the positioning end and the push end is a horizontally extending elongated elastic body of the stop member, a fourth bolt is inserted through the semicircular end and screwed into the second threaded hole, and the positioning end is inserted into the positioning hole, the push end is movably received in the through hole since the through hole has an inner diameter larger than the outer diameter of the push end.

* * * * *